US009553390B2

(12) United States Patent
Lu et al.

(10) Patent No.: US 9,553,390 B2
(45) Date of Patent: Jan. 24, 2017

(54) TRANSMISSION MODULE AND ELECTRICAL CONNECTOR THEREOF

(71) Applicant: ConnPro Industries Inc., New Taipei (TW)

(72) Inventors: Pei-Hsun Lu, New Taipei (TW); Ming-Ling Chan, Taipei (TW); Chien-Hsun Chu, Keelung (TW); Ping-Liang Wu, Keelung (TW)

(73) Assignee: CONNPRO INDUSTRIES INC., New Taipei (TW)

( * ) Notice: Subject to any disclaimer, the term of this patent is extended or adjusted under 35 U.S.C. 154(b) by 0 days.

(21) Appl. No.: 14/720,380

(22) Filed: May 22, 2015

(65) Prior Publication Data

US 2015/0340796 A1 Nov. 26, 2015

(30) Foreign Application Priority Data

May 23, 2014 (TW) ..... 103209138 U

(51) Int. Cl.

| | |
|---|---|
| ***H01R 13/627*** | (2006.01) |
| ***H01R 13/46*** | (2006.01) |
| ***H01R 13/629*** | (2006.01) |
| ***H01R 24/60*** | (2011.01) |
| *H01R 13/6581* | (2011.01) |
| *H01R 13/633* | (2006.01) |

(52) U.S. Cl.

CPC ..... *H01R 13/46* (2013.01); *H01R 13/629* (2013.01); *H01R 24/60* (2013.01); *H01R 13/6275* (2013.01); *H01R 13/6335* (2013.01); *H01R 13/6581* (2013.01)

(58) Field of Classification Search

CPC ..... H01R 13/6271; H01R 13/6275; H01R 13/6335; H01R 13/648; H01R 13/6581; H01R 13/46; H01R 13/629

USPC ..... 439/352, 483, 923, 607.01

See application file for complete search history.

(56) References Cited

U.S. PATENT DOCUMENTS

| | | | | |
|---|---|---|---|---|
| 7,281,937 | B2 * | 10/2007 | Reed | H01R 13/6275 439/352 |
| 7,828,579 | B2 * | 11/2010 | Huang | H01R 13/6275 439/155 |
| 8,251,733 | B2 * | 8/2012 | Wu | H01R 13/512 439/160 |
| 8,562,373 | B2 * | 10/2013 | Wu | H01R 13/6335 439/352 |
| 9,077,107 | B2 * | 7/2015 | Lloyd | H01R 13/6275 |
| 9,246,262 | B2 * | 1/2016 | Brown | H01R 13/62 |

* cited by examiner

*Primary Examiner* — Hae Moon Hyeon

(74) *Attorney, Agent, or Firm* — Muncy, Geissler, Olds & Lowe, P.C.

(57) ABSTRACT

A transmission module includes a cable and an electrical connector. The electrical connector includes a case and a transmission assembly. The case includes a standard section and a cable-collecting section. The standard section and the cable-collecting section together form a housing space. The transmission assembly is located in a part of the standard section. The cable is located in a part of the cable-collecting section, and electrically connected to the transmission assembly. The standard section has a standard height. The cable-collecting section has a non-standard height. The non-standard height is greater than the standard height, and a height difference between the non-standard height and the standard height is less than 1.5 millimeters.

11 Claims, 4 Drawing Sheets

TRANSMISSION MODULE AND ELECTRICAL CONNECTOR THEREOF

CROSS-REFERENCE TO RELATED APPLICATIONS

This non-provisional application claims priority under 35 U.S.C. §119(a) on Patent Application No(s). 103209138 filed in Taiwan, R.O.C. on May 23, 2014, the entire contents of which are hereby incorporated by reference.

TECHNICAL FIELD

The disclosure relates to an electrical connector, and more particularly to a transmission module including an electrical connector and a packaging unit with at least one wire management unit.

BACKGROUND

Cables are used for electrical communication and data transmission between two electrical devices. To assemble the cables with the electrical devices efficiently, multiple electrical connectors are mounted on two ends of the cables and the electrical devices, respectively. Accordingly, the cables are able to be inserted into the electrical devices through these electrical connectors in a pluggable manner. The electrical connector is, for example, a Mini Serial Attached Small Computer System Interface (Mini SAS, SFF 8644), Peripheral Component Interconnect Express (PCI Express), Serial Advanced Technology Attachment (SATA), Serial Attached Small Computer System Interface (SAS), Digital Visual Interface (DVI), High-Definition Multimedia Interface (HDMI), etc. The use of the electrical connectors not only improves the installation between the cables and the electrical devices but also enhances transmission speed and transmission quality of signals.

The electrical connector, for example, includes a connecting part and a cable housing part. The connecting part of the electrical connectors and sockets has to be standardized, and thus the electrical connector is able to fit and connect to the sockets mechanically. However, because a predetermined space for wire arrangement, soldering, circuit boards and electrical parts is required, this causes the difficulty in miniaturizing the cable housing part. That is to say that the electrical connector is tiered with the connecting part and the cable housing part varying levels of height. In addition, with respect to some of the electrical devices with multiple rows of sockets, for example, dual rows of sockets, a thickness of such electrical devices needs to be further increased because its height needs to match with the height of the connecting part. The thickness of the electrical devices is an important design factor for the electrical devices, and thus it cannot be able to be arbitrarily altered. In such a case, developers has to replace the dual rows of sockets arranged in a top-down manner by another electrical device with a signal row of socket, and thus expendability of this kind of electrical devices may be sacrificed.

Hence, developers had been trying to reduce the height of the electrical connector without increasing the thickness of the electrical devices, to allow the electrical connector to plug into dual rows of the sockets arranged in the top-down manner.

SUMMARY

One embodiment of the disclosure provides a transmission module including a cable and an electrical connector.

The electrical connector includes a case and a transmission assembly. The case includes a standard section and a cable-collecting section. The standard section and the cable-collecting section together form a housing space. The transmission assembly is located in a part of the standard section. The cable is located in a part of the cable-collecting section, and electrically connected to the transmission assembly. The standard section has a standard height. The cable-collecting section has a non-standard height. The non-standard height is greater than the standard height, and a height difference between the non-standard height and the standard height is less than 1.5 millimeters.

Another embodiment of the disclosure provides an electrical connector including a case and a transmission assembly. The case includes a standard section and a cable-collecting section. The standard section and the cable-collecting section together form a housing space. The transmission assembly is located in a part of the standard section. The standard section has a standard height. The cable-collecting section has a non-standard height. The non-standard height is greater than the standard height, and a height difference between the non-standard height and the standard height is less than 1.5 millimeters.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
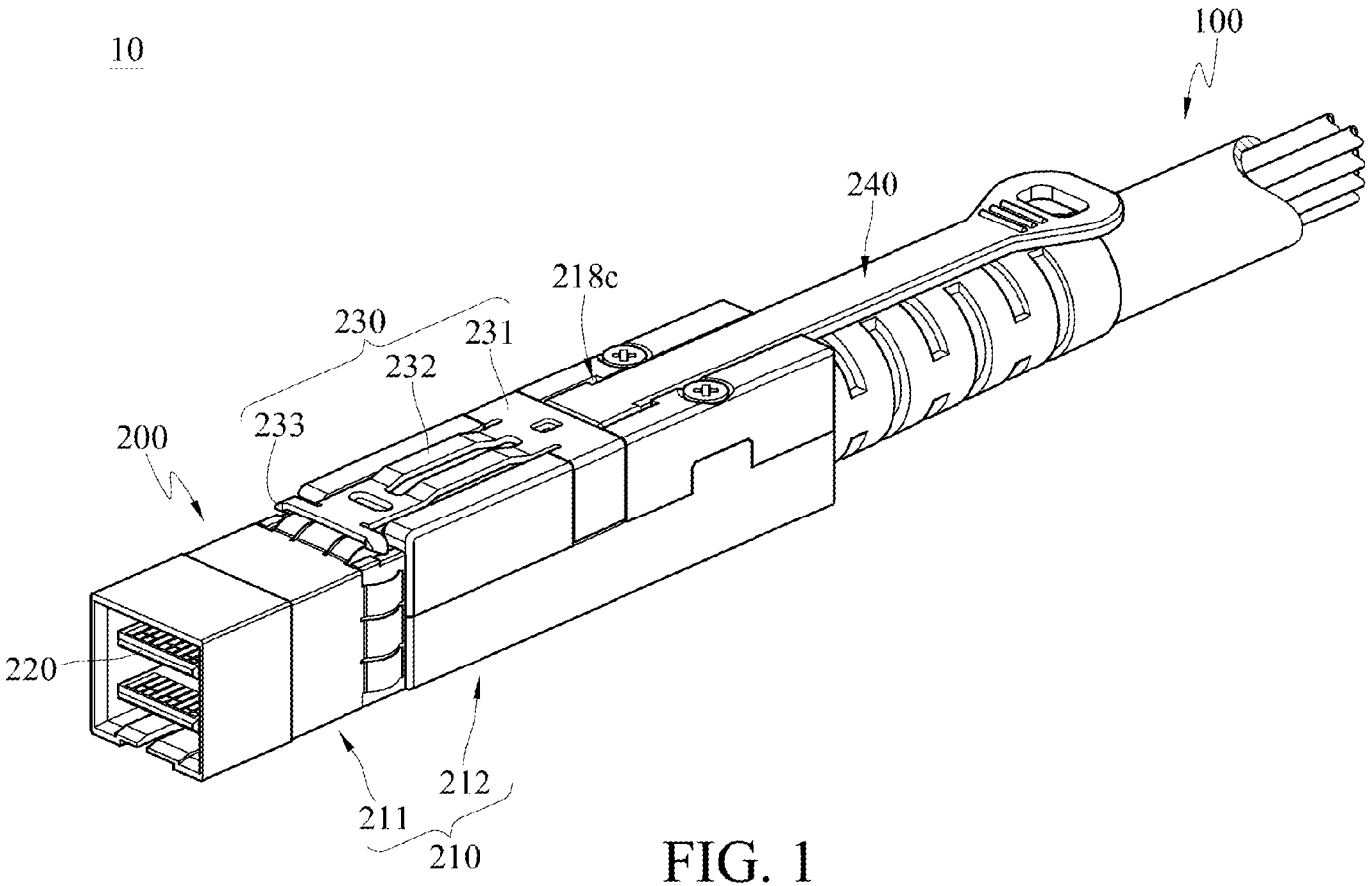
FIG. 1 is a perspective view of a transmission module according to an embodiment of the present disclosure.
Figure 2:
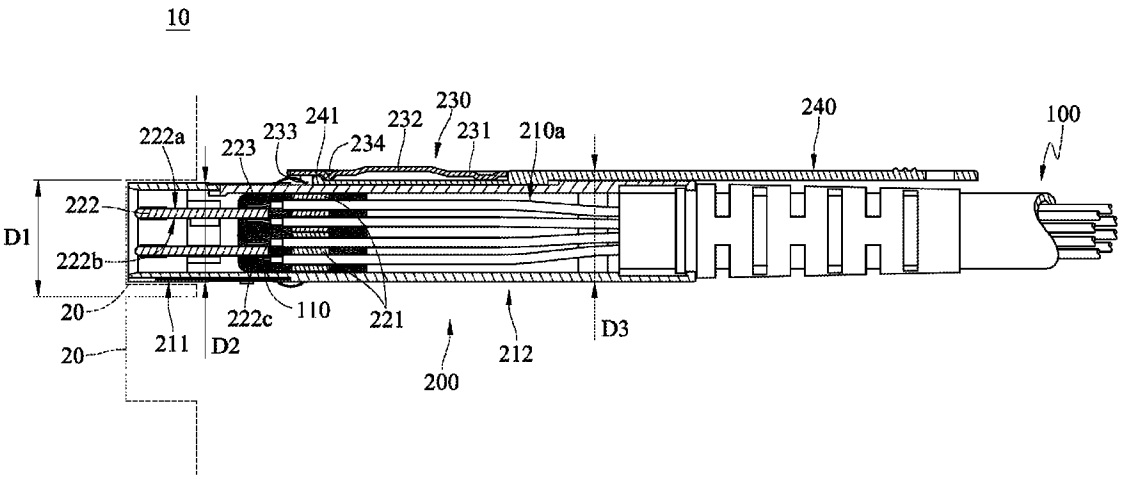
FIG. 2 is a cross sectional view of the transmission module of FIG. 1 which is inserted into sockets densely arranged in a top-down manner.

Please refer to FIG. 1 and FIG. 2. FIG. 1 is a perspective view of a transmission module according to an embodiment of the present disclosure. FIG. 2 is a cross sectional view of the transmission module of FIG. 1 which is inserted into sockets densely arranged in a top-down manner. In this embodiment, a transmission module 10 is inserted into one of the two sockets 20 densely arranged in a top-down manner, as shown in FIG. 2. The phrase "top-down manner" is defined that there are two rows of objects, one is on the top and the other is on the bottom. In addition, each of the sockets 20 has a standard height D1.

In this embodiment, the transmission module 10 includes a cable 100 and an electrical connector 200. The electrical connector 200 includes a case 210, a transmission assembly 220 and a shield 250. The case 210 includes a standard section 211 and a cable-collecting section 212. The standard section 211 and the cable-collecting section 212 together form a housing space 210*a*. In other words, the case 210 is divided into the standard section 211 and the cable-collecting section 212, the housing space 210*a* extends through the standard section 211 and the cable-collecting section 212, and is defined by the case 210. The transmission assembly 220 and the cable 100 are located in the hosing space 210*a*. More specifically, the transmission assembly 220 is located in a part of the standard section 211, and the cable 100 is located in a part of the cable-collecting section 212 and electrically connected to the transmission assembly 220. The case 210 is slightly tiered with the standard section 211 and the cable-collecting section 212 varying levels of height. In detail, the standard section 211 has a standard height D2, the standard height D2 of the standard section 211 meets with the standard height D1 of the socket 20. Dimensions of the sockets 20 and standard section 211 meet with standards of dimensions of Mini SAS HD. That is to say that the standard height D2 is defined as being met with the height of Mini SAS HD. Furthermore, the cable-collecting section 212 has a non-standard height D3. The non-standard height D3 is greater than the standard height D2, and a height difference between the non-standard height D3 and the standard height D2 (namely, D3 minus D2) is less than 1.5 millimeters. In this embodiment, the height difference between the non-standard height D3 and the standard height D2 (that is, D3 minus D2) is 1.35 millimeters. Accordingly, in a limited space, a plurality of transmission modules 10 is able to insert into the two sockets 20 which are densely arranged in the top-down manner, respectively. Hence, the expendability of an electrical device (not shown) with the sockets 20 is improved, and a thickness of the electrical devices is decreased.

Figure 3:
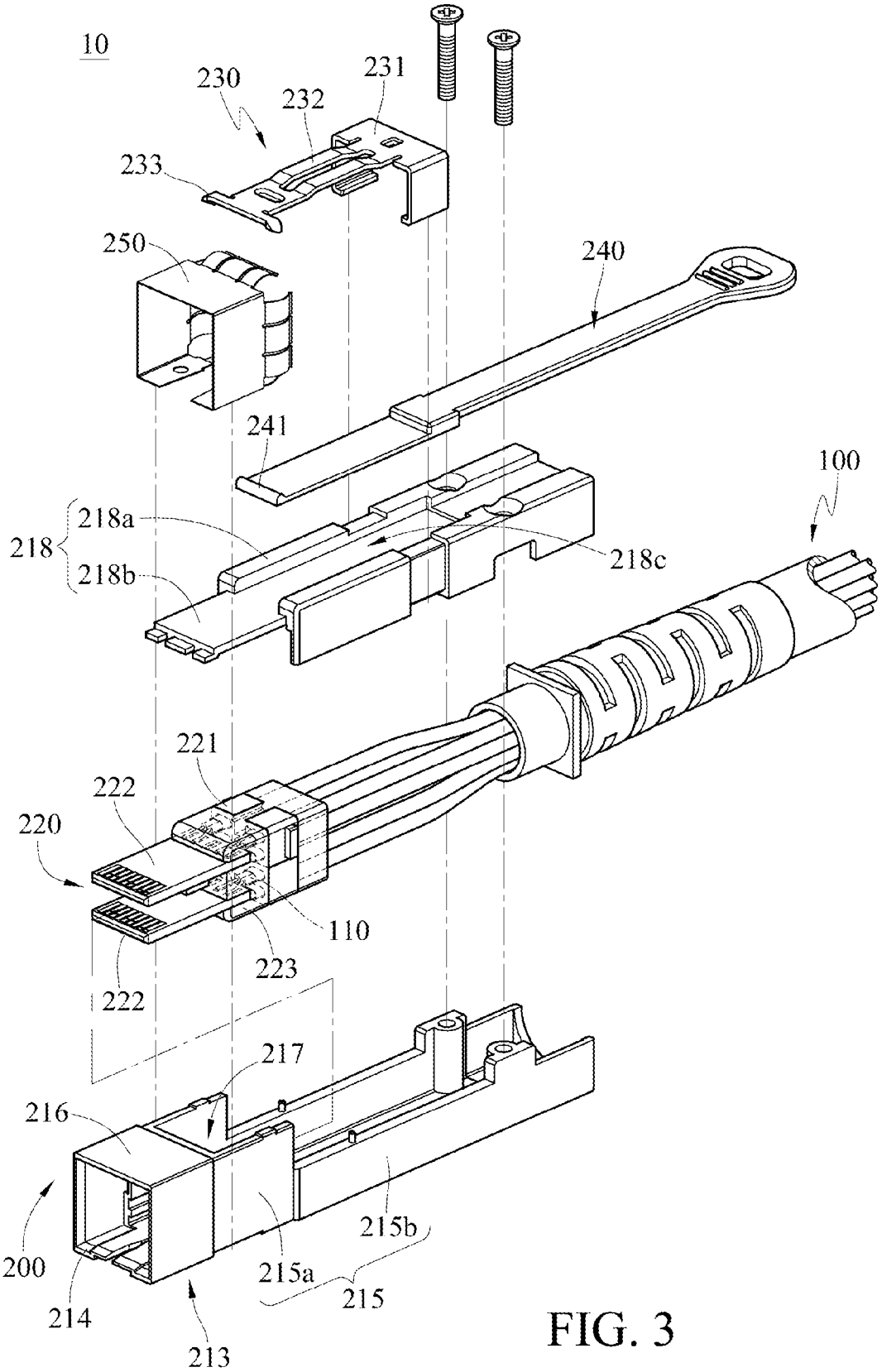
FIG. 3 is an exploded view of FIG. 1.
Figure 4:
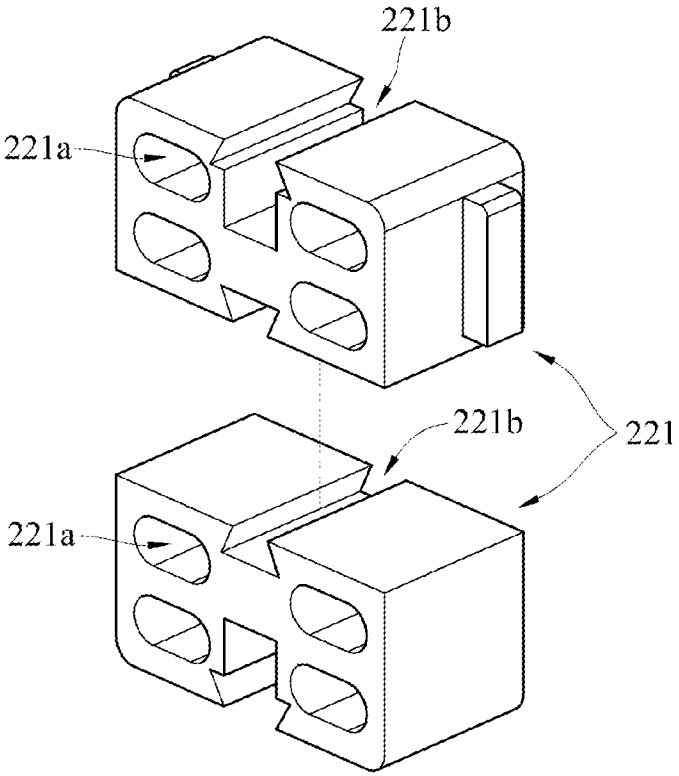
FIG. 4 is a perspective view of wire management units of FIG. 3.

In details, please refer to FIG. 3 and FIG. 4. FIG. 3 is an exploded view of FIG. 1. FIG. 4 is a perspective view of wire management units of FIG. 3. The cable 100 includes a plurality of cores 110. For example, the electrical connector 200 is a Mini SAS HD connector with four channels.

The case 210 includes a base 213 and a cover 218. The base 213 includes a bottom plate 214, two side plates 215 and a top plate 216. The two side plates 215 are connected to two sides of the bottom plate 214 that are opposite to each other. Each of the side plates 215 includes a first wall section 215*a* and a second wall section 215*b*. A height of the first wall section 215*a* is greater than a height of the second wall section 215*b*. Two sides of the top plate 216 that are opposite to each other are connected to parts of the two first wall sections 215*a*, respectively, so that an opening 217 is formed between the two first wall sections 215*a*.

The cover 218 includes a main body 218*a* and an extension part 218*b*. The main body 218*a* has a sliding groove 218*c* and is mounted on both the two second wall sections 215*b* of the side plate 215. The extension part 218*b* is connected to the main body 218*a*, is pressed against the top plate 216, and covers the opening 217 between the two first wall sections 215*a* so that the base 213 and the cover 218 together form the housing space 210*a*. A part of the bottom plate 214, two first wall sections 215*a*, the top plate 216 and the extension part 218*b* of the cover 218 together form the standard section 211 of the case 210. On the other hand, the other part of the bottom plate 214, the two second wall sections 215*b* and the main body 218*a* of the cover 218 together form the cable-collecting section 212 of the case 210.

The transmission assembly 220 includes two wire management units 221, two circuit boards 222 and a packaging unit 223.

Specifically, each of the wire management units 221 has a plurality of through-holes 221*a* and a plurality of dovetail grooves 221*b*. Each of the cores 110 penetrates through each of the through-holes 221*a*. In this embodiment, for example, the cores 110 are divided into a plurality of pairs, and the pairs of the cores 110 penetrate through the through-holes 221*a*, respectively. In other embodiments, a quantity of the through-holes 221*a* corresponds to a quantity of the cores 110, and thus the cores 110 are able to penetrate through the through-holes 221*a* one by one, respectively. The dovetail grooves 221*b* are dovetail-shaped, and widths of the dovetail grooves 221*b* are decreased from the inside toward the outside of the wire management units 221. In addition, the present disclosure is not limited to the quantity of the dovetail grooves 221*b*. In other embodiments, the quantity of the dovetail grooves 221*b* is one.

Furthermore, two sides of each of the two wire management units 221 that are opposite to each other are detachably assembled with the two first wall sections 215*a* of the two side plates 215, respectively, in order to fix the cores 110 to the base 213 through the two wire management units 221.

The circuit boards 222 are located between the bottom plate 214 and the top plate 216. Each of the circuit boards 222 has a first surface 222*a* and a second surface 222*b*, and includes a plurality of electrical contacts 222*c*. The second surface 222*b* facing the bottom plate 214 is opposite to the first surface 222*a* facing the top plate 216. The electrical contacts 222*c* are located on the first surface 222*a* and the second surface 222*b* of each of the two circuit boards 222, respectively. The cores 110 are electrically connected to the electrical contacts 222*c* on the two first surfaces 222*a* and the electrical contacts 222*c* on the two second surface 222*b*, respectively.

The packaging unit 223 is, for example, a resin. The packaging unit 223 wraps and encloses parts of each of the cores 110, the two wire management units 221 and parts of the two circuit boards 222. In detail, an end of each of the cores 110 contacting the electrical contacts 222*c*, the two wire management units 221 and the electrical contacts 222*c* of the two circuit boards 222 are covered by the packaging unit 223. Consequently, the circuit boards 222 are combined with the wire management units 221 to be fixed in the base 213 through the wire management units 221.

In addition, when the packaging unit 223 wraps and encloses the two wire management units 221, the electrical contacts 222*c* of each of the two circuit boards 222 and the ends of the cores 110 that contact the electrical contacts 222*c*, the packaging unit 223 is embedded in the dovetail grooves 221*b* of the wire management units 221. Thus, the wire management units 221 and the packaging unit 223 are more firmly combined with each other.

Two ends of the shield 250 that are opposite to each other are combined with the bottom plate 214, respectively. The shield 250 surrounds the two first wall sections 215*a* of the two side plates 215 and the extension part 218*b* of the cover 218.

Furthermore, in this and some embodiments, the electrical connector 200 further includes a hooking element 230 and a releasing element 240. The hooking element 230 includes a combining part 231, an elastic part 232, a hooking part 233 and a protruding part 234. The combining part 231 and the hooking part 233 are connected to two ends of the elastic part 232 that are opposite to each other, respectively. The combining part 231 is detachably mounted and clipped to the case 210. The hooking part 233 is for hooking holes (not shown) of the electrical device (not shown), and thus the electrical connector 200 is able to be fixed on the electrical device. The protruding part 234 is located on a side of the elastic part 232 facing the case 210. The releasing element 240 includes a pushing part 241. The releasing element 240 is slidably mounted on the sliding groove 218*c*, and the pushing part 241 is located between the hooking element 230 and the case 210. The releasing element 240 is able to slide relative to the case 210, thus the pushing part 241 is able to push the protruding part 234 to force the hooking part 233 to be moved away from the case 210, which allows users to pull out the electrical connector 200 inserted into the electrical device. In addition, the hooking part 233 is able to move toward the case 210 when the pushing part 241 and the protruding part 234 are disengaged so that the hooking part 233 is able to hook the holes of the electrical device.

In addition, in this embodiment, the combining part 231 is a non-enclosed arm, for example, a C-shaped unit. Thus users are able to either mount the hooking element 230 onto the case 210 or detach the hooking element 230 from the case 210 easily without using tools.

According to the packaging unit 223 which is combined with the cores 110, benefits of the wire management units 221 and the circuit boards 222 as discussed above:

First, each of the cores 110 is able to contact and be directly fixed on each of the electrical contacts 222*c* through the packaging unit 223, which facilitates a process of soldering the cores 110 to the electrical contacts 222*c*.

Second, a usage of an inner space of the electrical connector 200 is optimized, thus parts of the inner space that are occupied by cores 110 are being minimized so that the non-standard height D3 of the cable-collecting section 212 of the case 210, as shown in FIG. 2, is thinned to be about 11.8 millimeters (mm). Accordingly, the non-standard height D3 of the cable-collecting section 212 of the case 210 is much closer to the standard height D2 of the standard section 211 of the case 210 which is about 10.45 millimeters (mm). Hence, the height difference between the non-standard height D3 and the standard height D2 (that is, D3 minus D2) is less than 1.55 millimeters which is a traditional height difference between the non-standard height D3 and the standard height D2 (that is, D3 minus D2). As a result, the transmission module 10 with two rows of circuit boards is able to insert into the two sockets 20 which are densely arranged in the top-down manner.

For example, regarding a 1U server (not shown), a height of the 1U server is about 1.75 inches (about 44.5 millimeters). In this embodiment, the highest height of the non-standard height of the transmission module 10 is about 11.8 millimeters. The height of the 1U server minus the heights of the two transmission modules 10 approximately equals to 20 millimeters. That is, the 1U server has a space with 20 millimeters in height for arranging the two-row sockets. Accordingly, the developers are able to develop the 1U servers with the two-row sockets which are arranged in a top-down manner easily, and thus expandability of the 1U serves are improved.

In contrast, a height of a traditional transmission module is about 17.5 millimeters. In such a case, the height of the 1U server minus a total height of the two traditional modules equals about 10 millimeters, then the result further minus a thickness of a case of the 1U server (about 1 millimeter) approximately equals to 8 millimeters, which means it is difficult for the developers to arrange the two sockets in the space with only 8 millimeters in height. In some cases, the developers are unable to arrange the two sockets in the top-down manner, and the expandability of the 1U serves is restricted.

According to the transmission module and the electrical connector of the embodiments of the disclosure, the cable is combined with the circuit boards through the wire management units and the packaging unit. Thus, the usage of the inner space of the electrical connector is optimized, and the non-standard height of the cable-collecting section of the case is thinned to be 11.8 millimeters, which is close to the standard height of the standard section of the case, i.e., 10.45 millimeters. Accordingly, it is able to prevent the two cable-collecting sections of the two cases which are arranged in the top-down manner from interfering with each other, and thus the two transmission modules are able to insert into the two sockets which are densely arranged in the top-down manner at the same time.

What is claimed is:

1. A transmission module, comprising:

a cable; and an electrical connector comprising a case and a transmission assembly, the case comprising a standard section and a cable-collecting section, the standard section and the cable-collecting section together form a housing space, the transmission assembly being located in a part of the standard section, the cable being located in a part of the cable-collecting section and electrically connected to the transmission assembly, wherein the standard section has a standard height, the cable-collecting section has a non-standard height, the non-standard height is greater than the standard height, and a height difference between the non-standard height and the standard height is less than 1.5 millimeters.

2. The transmission module according to claim 1, wherein the standard height of the standard section meets with dimensions of Mini SAS HD.

3. A transmission module, comprising:

a cable; and an electrical connector comprising a case and a transmission assembly, the case comprising a standard section and a cable-collecting section, the standard section and the cable-collecting section together form a housing space, the transmission assembly being located in a part of the standard section, the cable being located in a part of the cable-collecting section and electrically connected to the transmission assembly, wherein the standard section has a standard height, the cable-collecting section has a non-standard height, the non-standard height is greater than the standard height, and a height difference between the non-standard height and the standard height is less than 1.5 millimeters;

wherein the case comprises a base and a cover, the base comprises a bottom plate, two side plates and a top plate, the two side plates are connected to two sides of the bottom plate that are opposite to each other, each of the side plates comprises a first wall section and a second wall section, a height of the first wall section is greater than a height of the second wall section, two sides of the top plate that are opposite to each other are connected to parts of the two first wall sections, respectively, so that an opening is formed between the two first wall sections, the cover comprises a main body and an extension part that are connected to each other, the main body of the cover is assembled with the two second wall sections of the side plate, the extension part is pressed against the top plate and covers the opening between the two first wall sections, so that the base and the cover together form the housing space, a part of the bottom plate, the two first wall section, the top plate and the extension part of the cover together form the standard section of the case, and the other part of the bottom plate, the two second wall sections and the main body of the cover together form the cable-collecting section of the case.

4. The transmission module according to claim 3, wherein the transmission assembly comprises at least one wire management unit, at least one circuit board and a packaging unit, two sides of the at least one wire management unit that are opposite to each other are clipped to the two first wall sections, respectively, the at least one circuit board is located between the bottom plate and the top plate, the cable extends through the at least one wire management unit and is electrically connected to the at least one circuit board, the packaging unit wraps parts of the at least one wire management unit and the cable, so that the at least one circuit board is combined with the at least one wire management unit and fixed in the base through the at least one wire management unit.

5. The transmission module according to claim 4, wherein the cable comprises a plurality of cores, the at least one circuit board comprises a plurality of electrical contacts, the plurality of cores pass through the at least one wire management unit and are respectively electrically connected to the plurality of electrical contacts, and the packaging unit wraps the plurality of cores, the at least one wire management unit and the plurality of electrical contacts.

6. The transmission module according to claim 5, wherein a quantity of the at least one circuit board is two, each of the circuit boards has a first surface and a second surface that are opposite to each other, the plurality of electrical contacts is located on the first surfaces and the second surfaces of the two circuit boards, respectively, and the plurality of cores is electrically connected to the plurality of electrical contacts located on the two first surfaces and the plurality of electrical contacts located on the two second surfaces, respectively.

7. The transmission module according to claim 5, wherein the quantity of the at least one wire management unit is two, the two wire management units correspond to the two circuit boards, and the packaging unit wraps the two wire management units and the plurality of electrical contacts located on the two circuit boards.

8. The transmission module according to claim 4, wherein the at least one wire management unit comprises at least one dovetail groove, and the packaging unit wraps the at least one wire management unit and is embedded in the at least one dovetail groove.

9. The transmission line module according to claim 3, wherein the body further comprises a sliding groove, the electrical connector further comprises a hooking element and a releasing element, the hooking element comprises a combining part, a elastic part, a hooking part and a protruding part, the combining part and the hooking part are connected to two ends of the elastic part that are opposite to each other, respectively, the combining part is detachably mounted to the body, the protruding part is located on a side of the elastic part facing the body, the releasing element comprises a pushing part, the releasing element is slidably mounted on the sliding groove, the pushing part is located between the hooking element and the body, and the pushing part is for pushing the protruding part so that the hooking part is moved away from the body.

10. The transmission module according to claim 3, wherein the electrical connector further comprises a shield, and two ends of the shield that are opposite to each other are combined with the bottom plate and surround the two first wall sections of the two side plates and the extension part of the cover, respectively.

11. An electrical connector, comprising:

a case comprising a standard section and a cable-collecting section, and the standard section and the cable-collecting section together form a housing space; and a transmission assembly being located in a part of the standard section, wherein the standard section has a standard height, the cable-collecting section has a non-standard height, the non-standard height is greater than the standard height, and a height difference between the non-standard height and the standard height is less than 1.5 millimeters.

* * * * *